US005375188A

United States Patent [19]

Serikawa et al.

[11] Patent Number: 5,375,188

[45] Date of Patent: Dec. 20, 1994

[54] MUSIC/VOICE DISCRIMINATING APPARATUS

[75] Inventors: Mitsuhiko Serikawa, Nishinomiya; Akihisa Kawamura, Hirakata; Masaharu Matsumoto, Katano; Hiroko Numazu, Kadoma, all of Japan

[73] Assignee: Matsushita Electric Industrial Co., Ltd., Osaka, Japan

[21] Appl. No.: 896,044

[22] Filed: Jun. 8, 1992

[30] Foreign Application Priority Data

Dec. 4, 1991 [JP] Japan ..... 3-320184
Jun. 6, 1992 [JP] Japan ..... 3-134829

[51] Int. Cl.[5] ..... G10L 3/02

[52] U.S. Cl. ..... 395/2.24; 381/11; 381/12

[58] Field of Search ..... 381/41, 11, 12; 395/2.24

[56] References Cited

U.S. PATENT DOCUMENTS 4,236,041 11/1980 Thomas ..... 381/12
4,553,257 11/1985 Mori et al. ..... 381/57
4,953,212 8/1990 Otsubo ..... 381/1
5,129,004 7/1992 Imai et al. ..... 381/86
5,155,770 10/1992 Maejima ..... 381/11
5,210,796 5/1993 Hirabayashi et al. ..... 381/12

FOREIGN PATENT DOCUMENTS 2439505 5/1980 France ..... H03D 13/00
64-5200 1/1989 Japan .

OTHER PUBLICATIONS

"Neuartige Stereo-Anzeige", J. Rathlev, Funk-Technik, vol. 30, No. 6, Mar. 1975, pp. 129-130.

*Primary Examiner*—Allen R. MacDonald
*Assistant Examiner*—Richard J. Kim
*Attorney, Agent, or Firm*—Wenderoth, Lind & Ponack

[57] ABSTRACT

A music/voice discriminating apparatus is composed of a signal processing portion for effecting the signal processing upon input acoustic signals, a music/voice deciding portion for discriminating whether the input acoustic signals are music or voice, a first signal processing portion for optimally setting acoustic parameters for the signal processing respectively for music or voice, and a second signal processing portion for controlling the acoustic parameters of the first signal processing portion in accordance with the decision results of the music/voice deciding portion so that it may become a desirable value set in the second parameter setting portion.

6 Claims, 6 Drawing Sheets

MUSIC/VOICE DISCRIMINATING APPARATUS

BACKGROUND OF THE INVENTION

The present invention generally relates to a music/-voice discriminating apparatus and to a music/voice processing apparatus which can be used for sound field control related appliances where an expanding feeling sound, an orientation feeling sound, and an articulation feeling sound can be better realized in accordance with a type of sources to be reproduced, for example, in an audition room.

In recent years, the technological tendency is to change from fundamental tone reproduction to fundamental sound field reproduction in an acoustical field. Field control apparatuses for realizing sound fields such as those of a concert hall or the like are being developed. In home audio equipment, car audio equipment and so on, sound field control apparatuses are provided for reproducing using a multichannel speaker sound effects such as initial reflection sounds and reverberation sounds which are added to inputted acoustical signals. Some of these apparatuses have a source discriminating function, which can automatically adjust in a maximum value the level of the sound effects in accordance with the source type (for example, Japanese Patent Laid-Open Publication No. 64-5200).

As one example of the above described conventional source discriminating function, the size of the difference signal amplitude of the L, R two channel signals to be stereo-transmitted is calculated so as to set the level of the sound effect in inverse proportion to the difference. Namely, in the case of a source having a low reverberation component at the time of music reproduction, relatively more sound effect is added as the difference signal amplitude becomes small. In the opposite case, relatively less sound effect is added less.

However, in the conventional construction, when a stereo music broadcast changes to a monoral voice such as news or the like during, for example, FM broadcast reception, the difference signal of the L, R signals becomes almost zero and is judged as dry music with the reverberation components being extremely low. The added sound effects becomes of a maximum level, with a problem arising in that the speech intelligibility is lowered.

Further, during stereo music reproduction, the amplitude values of the L, R difference signals are normally varied, for example, at each silent pause in the music, with a problem arising in that the sound effect level can drastically vary in a single musical piece, resulting in an unnatural sound.

SUMMARY OF THE INVENTION

Accordingly, the present invention has been developed with a view to substantially eliminating the above discussed drawbacks inherent in the prior art, and has for its essential object to provide an improved music/-voice discriminating apparatus.

Another important object of the present invention is to provide an improved music/voice discriminating apparatus, which can judge with high accuracy whether or not inputted acoustical signals represent music or voice including the discrimination of a sound condition or a silence condition.

In accomplishing these and other objects, according to one preferred embodiment of the present invention, there is provided a music/voice discriminating apparatus which includes an adding portion for adding L, R stereo signals to be inputted, a subtracting portion for subtracting the signals, a discriminating portion. The discriminating portion is composed of a sound/silent judging portion for judging whether the inputted L, R signals represent a sound or silence, a music/voice judging portion composed of a music comparing portion for judging whether or not the input signals represent music, and a voice comparing portion for judging whether or not the inputted signals represent voice.

The present invention discriminates silence when the amplification values of the adding signals of the L, R signals are a present constant value or lower so that the judgment of music/voice is not effected. In the case of sound, the input signal is discriminated as music when the amplitude ratio of the difference signal of L, R and the sum signal of L, R is a present constant value or more, and the input signal is discriminated as voice when the ratio is a present constant value or lower. Otherwise, the judgement of music/voice is reserved when neither condition applies.

Therefore, unnecessary processing can be avoided at the time of silence in processing operation and in accordance with the type of input signals. During the time of sound, the proper signal processing can be instructed only when music or voice can be positively judged. When music or voice cannot be judged, processing content change in the wrong direction can be avoided by the maintenance of the processing contents as they are. Uncertain factors caused by variations of the L, R signal components with, a portion of the voice or the music and by changes in sound volume, disturbance noises and so on are removed so as to effect a positive judgment of the music/voice. Further, a stable acoustic signal processing operation can be effected with the use of the decision results.

Another object of the present invention is to provide a music/voice processing apparatus which is capable of optimum and stable sound field reproduction in accordance with the input source by gradually controlling where necessary acoustic parameters little by little to an optimum value in accordance with a judgment result as to whether the acoustical signal inputted represents sound or silence, and whether the signal represents music or voice in the case of sound.

In accomplishing these and other objects, according to one preferred embodiment of the present invention, there is provided a music/voice processing apparatus which includes a signal processing portion for effecting signal processing upon inputted acoustic signals, a music/voice deciding portion which continuously or periodically decides whether the input acoustic signals are silence, music or voice, a parameter control portion for variably controlling acoustic parameters so as to effect the acoustic signal processing in the above described signal processing in accordance with the decision results of the above described music/voice deciding portion, a parameter setting portion for optically setting the above described parameter control portion values as the acoustic parameter values.

The present invention corrects the existing state of acoustic parameters little by little so that the existing state of acoustic parameters may become closer to optimum values for music when they have been decided as representing music, or to optimum values for voice when they have been decided as representing voice in the signal processing portion in accordance with the continuous or periodic decision results in the music/-voice deciding portion, and does not correct the existing state of acoustic parameters when a silence condition has been discriminated. In the music/voice deciding portion, the judging reference of music and voice is strictly set so as to avoid an erroneous decision as much as possible, and the existing state of acoustic parameters are not corrected even during a sound condition if the music/voice discriminating cannot be made.

By effecting gradual correction little by little of the acoustic parameters together with the strict decision of the music or voice, erroneous judgements are kept to a minimum. When music or voice cannot be discriminated during a sound condition, the correction of the acoustic parameters is reversed so as to retain the existing state, so that an acoustic parameter change in the wrong direction can be avoided, thus contributing towards a stable operation.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
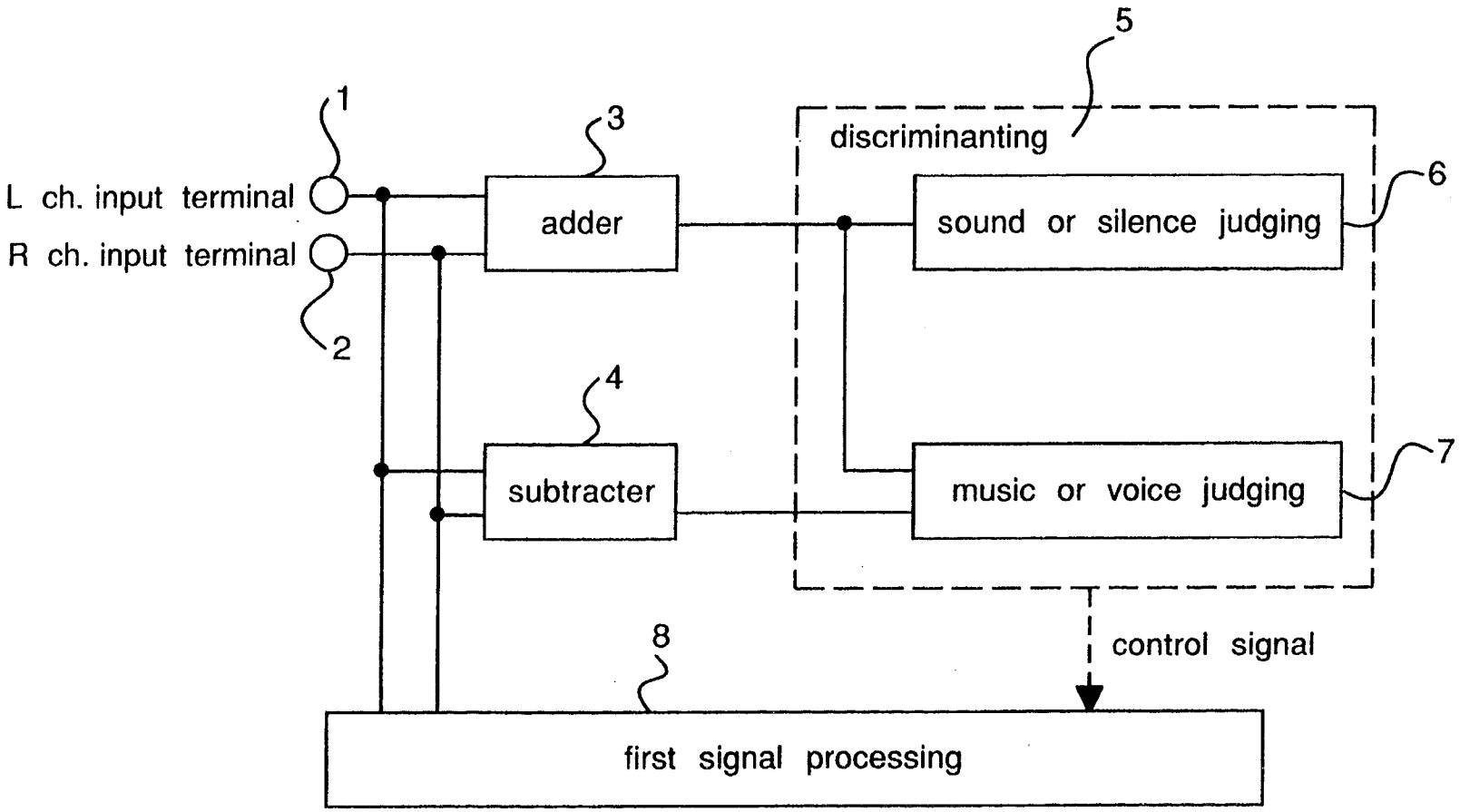
FIG. 1 is a block diagram showing one example of the configuration of a music/voice discriminating apparatus of the present invention.

Before the description of the present invention proceeds, it is to be noted that like parts are designated by like reference numerals throughout the accompanying drawings.

Referring now to the drawings, there is shown in FIG. 1, a music/voice discriminating apparatus according to one preferred embodiment of the present invention, which includes an L channel input terminal 1 and an R channel input terminal 2, each receiving stereo signals to be transferred from a signal source of an FM tuner or the like; an adding portion 3 for adding the inputted L signal and R signal; a subtracting portion 4 for subtracting the inputted L signal and R signal to obtain a resultant 1L−R1; a first sound/silence judging portion 6 for deciding whether the input signals are sound or silence in accordance with the L, R sum signal from the adding portion 3; a music/voice deciding portion 7 for deciding whether the input signals are music or voice in accordance with the L, R sum signal and the L, R difference signal from the adding portion 3 and the subtracting portion 4; a discriminating portion 5 composed of the first sound/silence judging portion 6 and the music/voice judging portion 7; and a first signal processing portion 8 for effecting an acoustic signal processing operation suitable for music or voice in accordance with a control signal transferred from the discriminating portion 5.

The operation of the music/voice discriminating apparatus constructed as described hereinabove in one embodiment of the present invention will now be described.

In FIG. 1, acoustic signals inputted from the L channel input terminal 1 and R channel input terminal 2 are added and subtracted respectively in the adding portion 3 and the subtracting portion 4, and the resultant signals are transferred to a discriminating portion 5. In the discriminating portion 5, it is judged whether the inputted acoustic signals represent sound or silence in accordance with a process shown in detail in FIG. 2, and, then, in the case where the signals are judged as sound, whether they represent music: or voice. The discrimination results are then transferred to the first signal processing portion 8 as a control signal. In the first signal processing portion 8, the L, R signals inputted to the L channel input terminal 1 and the R channel input terminal 2 are received. When they have been determined to represent music in accordance with the control signal received from the discriminating portion 5, signal processing suitable for music is effected in the first signal processing portion 8, and when they have been determined to represent voice, signal processing suitable for voice is effected. When the signals have been determined to represent silence or when the discrimination of music/voice cannot be positively effected even when sound is represented, the existing state of signal processing is retained so as to avoid the danger of changing the processing content in the wrong direction.

Figure 2:
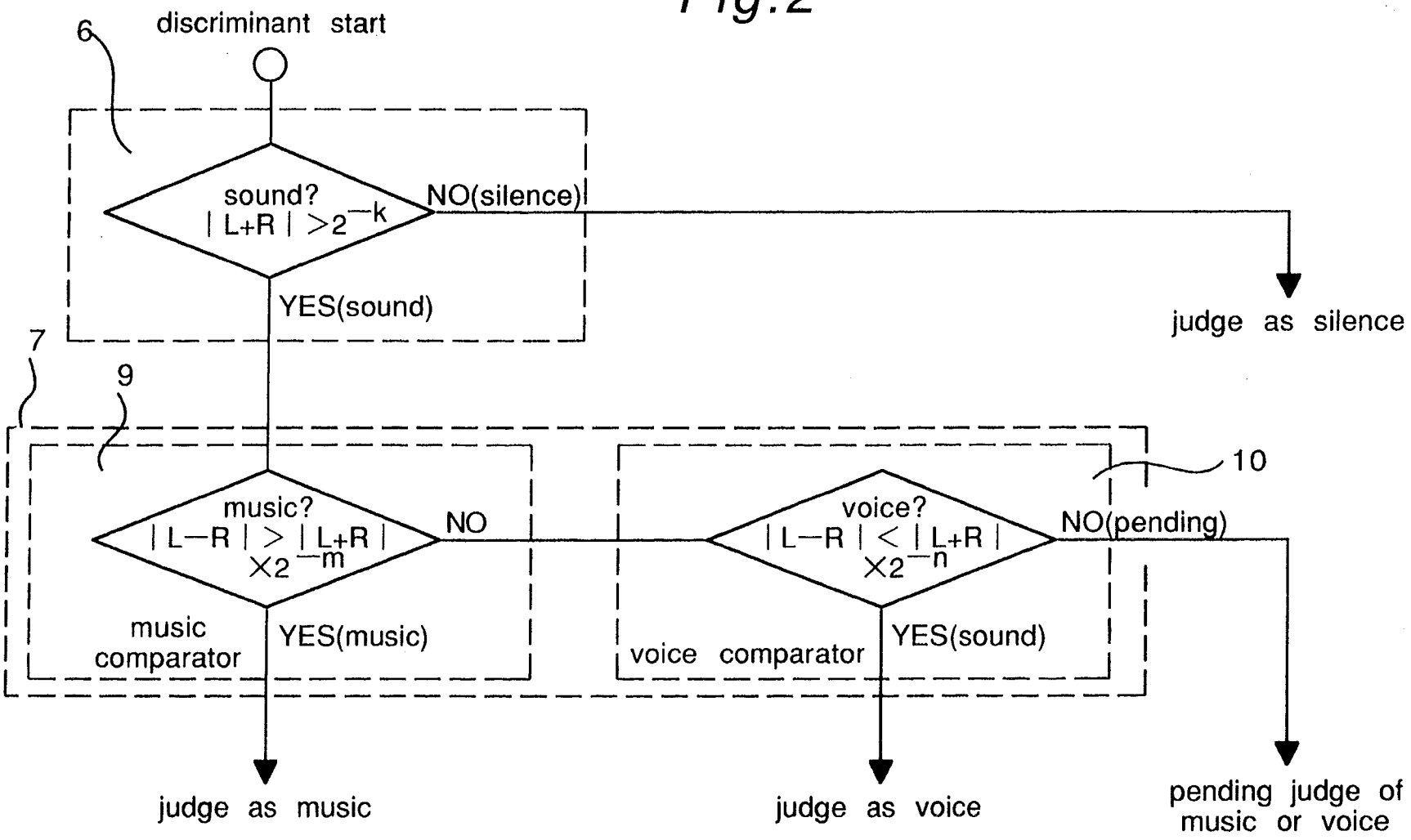
FIG. 2 is a flow chart showing a discriminating algorithm in a discriminating portion which is a component of the music/voice discriminating apparatus of the present invention.

As shown in FIG. 2, the music/voice judging portion 7 is composed of a music comparing portion 9 for deciding whether or not the input signal is music in accordance with a comparison between the amplitude ratio of the L, R difference signals (1L−R1) and L, R sum signals (1L+R1), and a set constant value, and a voice comparing portion 10 for judging whether or not the input signal is voice in accordance with comparison between the amplitude ratio and the set constant value. The discriminating process of the discriminating portion 5 will be described in more detail in accordance with FIG. 2.

At first, in the sound/silence judging portion 6 of the discriminating portion 5, the amplitude values of the L, R sum signals are compared with a predetermined constant value $2^{-k}$. The value of the constant k is set so that the constant value $2^{-k}$ may be slightly larger than the noise level at, for example, the time of a silence signal. Accordingly, sound is discriminated when the sum signal is larger than $2^{-k}$, and when the result of the comparison is positive, the process proceeds to the music comparing portion 9, and when the comparison result is negative, the input signal is decided to represent and silence a control signal denoting silence is fed to the signal processing portion 8 without processing of the music/voice discrimination.

When sound has been discriminated in the above process, the amplitude value of the L, R difference signal is compared with the product resulting from the multiplication of the amplitude value of the L, R sum signal and a constant value $2^{-m}$ set in advance in the musical comparing portion 9 of the music/voice judging portion 7. When the difference signal is larger than the product, music is discriminated, and a control signal denoting music is fed to the first signal processing portion 8, when the difference signal is not larger than the product, the process proceeds to the next voice comparing portion 10.

The comparison computation of the music/voice judging portion 7 determines whether or not the difference components of the stereo acoustic signals are a certain ratio or more of the sum components. Generally, in the case of stereo music, the difference components of the L, R signals become considerably larger as compared with the case of the voice of news programs. The constant m is set so that the constant value $2^{-m}$ is sufficiently larger than the top limit value of the ratio of the difference components with respect to the sum components in a case of voice in consideration of the noise level, so that an erroneous decision can be positively avoided when the input signals are voice, and also, so that music can be identified with high probability of correctness.

When the input acoustic signals are determined not to represent music in the above process, the amplitude value of the L, R difference signals is compared with a product resulting from the multiplication of the amplitude value of the L, R sum signals and a constant value $2^{-n}$ set in advance in the voice comparing portion 10. When the difference signal is smaller, voice is discriminated, and a control signal denoting voice is fed to the signal processing portion 8. In the opposite case, a control signal denoting a decision reservation is output or no control signal is transferred to the first signal processing portion 8 so as to indicate that a positive judgement cannot be effected with respect to either music or voice.

The comparison computation of the voice comparing portion 10 determines whether or not the difference components of the stereo acoustic signals are a certain ratio or less than the sum components. As described hereinabove, the difference components of the L, R signals of voice become considerably small as compared with that of stereo music generally. The constant n is set so that the constant value $2^{-n}$ is near a top limit value of a ratio of the difference components with respect to the sum components in the case of voice with consideration of the noise level so that voice can be discriminated with a high probability of correctness.

In the music comparing portion 9 and the voice comparing portion 10, an extremely stable deciding operation is obtained even if the volume level of the inputted acoustic signal changes, since the amplitude ratio (1L−R1:1L+R1) between the L, R difference signal and the sum signal is used.

An embodiment of the music/voice processing apparatus of the present invention will be described hereinafter.

Figure 3:
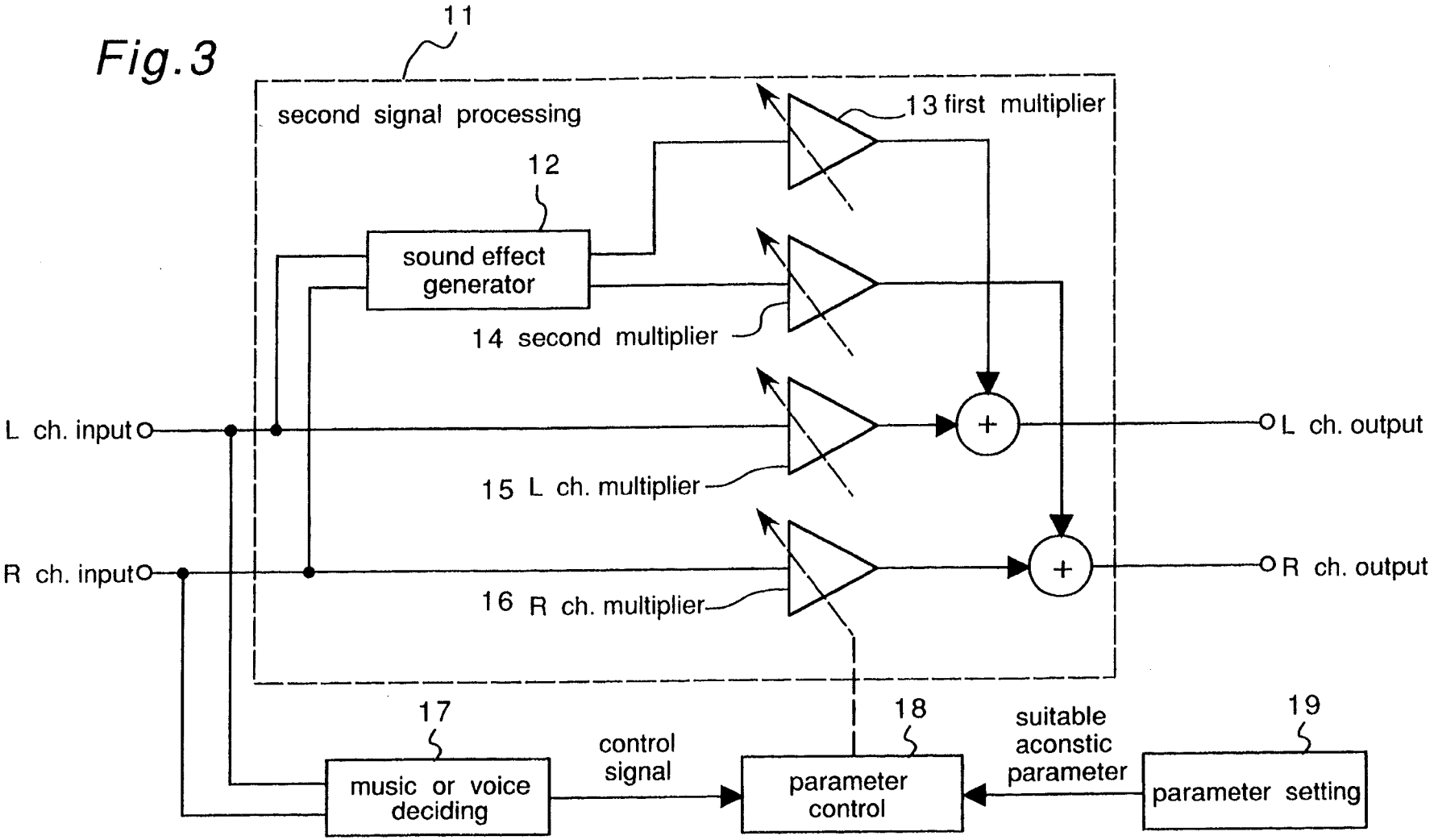
FIG. 3 is a block diagram showing one example of the configuration of a music/voice processing apparatus of the present invention.

Referring to FIG. 3, reference numeral 11 is a second signal processing portion for effecting signal processing upon the L/R stereo input signals to be transmitted from a signal supply. Reference numeral 12 is a sound effect generating portion for generating effective sounds such as an initial reflection sound, a reverberation sound and so on in accordance with the stereo input signals, reference numerals 13 and 14 are a first sound effect adjusting multiplier and a second sound effect adjusting multiplier for adjusting the volume of the output signals of the sound effect generating portion 12, and reference numerals 15 and 16 are an L channel direct sound adjusting multiplier and an R channel direct sound adjusting multiplier for adjusting the volume of the stereo input signal, which are all internal components of the second signal processing portion 11. Reference numeral 17 is a music/voice deciding portion for determining whether the input signals represent music, voice or silence in accordance with the stereo input signals, and for outputting a decision result as a control signal, and reference numeral 18 is a parameter control portion which is adapted to receive the control signal outputted from the music/voice deciding portion 17 so as to effect variable control of the acoustic parameters in accordance with the decision result. In the present embodiment, the acoustic parameters are the respective gains of the first sound effect adjusting multiplier 13, the second sound effect adjusting multiplier 14, the L channel direct sound adjusting multiplier 15, and the R channel direct sound adjusting multiplier 16. Reference numeral 19 is a parameter setting portion for setting in the parameter control portion 18 a most suitable value for music and a most suitable value for voice with respect to the above described gains.

Figure 4:
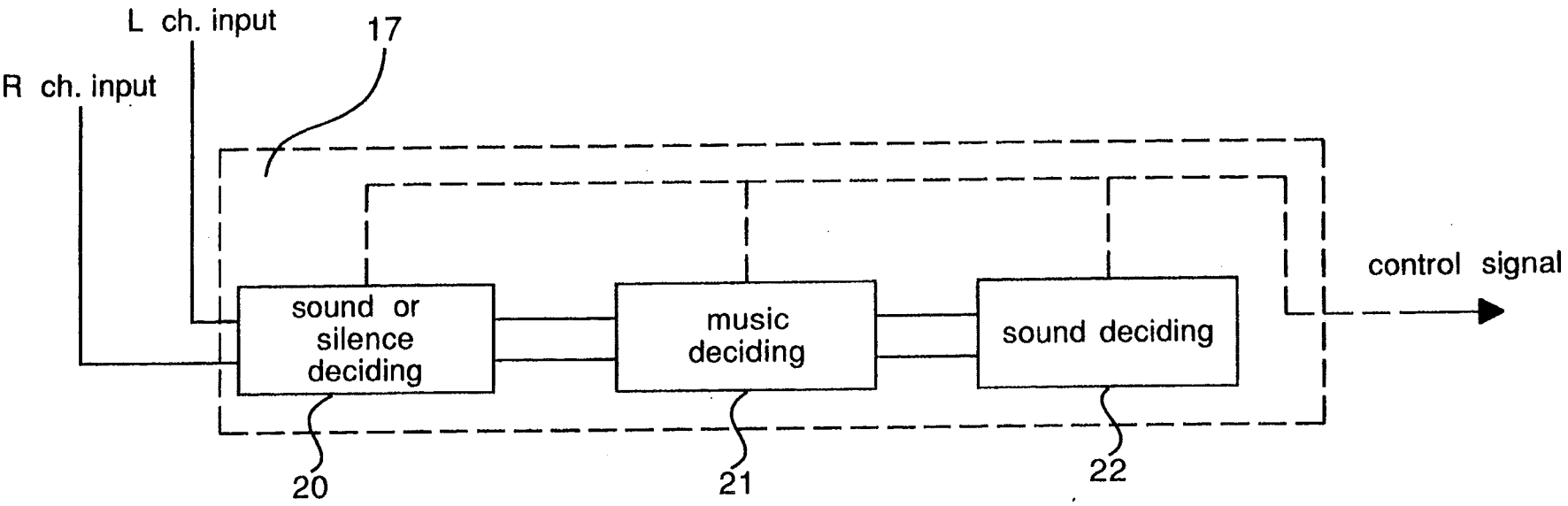
FIG. 4 is a block diagram showing an internal configuration of a music/voice deciding portion which is an element of a music/voice processing apparatus of the present invention.

Also, as shown in FIG. 4, reference numeral 20 is a second sound/silence deciding portion for discriminating whether the stereo input signal represents sound or silence, and for outputting a control signal denoting silence when the input signals have been discriminated as silence, reference numeral 21 is a music deciding portion for discriminating whether the stereo input signals represent music when the signals have been judged as sound in the second sound/silence deciding portion 20, and for outputting a control signal denoting music when the input signals have been discriminated as music, and reference numeral 22 is a voice deciding portion for discriminating whether the stereo input signals represent voice when the input signals have not been discriminated as music in the music deciding portion 21, and for outputting a control signal denoting voice when voice has been discriminated and a control signal denoting that a decision is reserved due to difficulty in the discrimination of the music/voice when judged as non-voice. These are the internal components of the music/voice deciding portion 17.

The operation of music/voice processing apparatus in the embodiment of the present invention constructed as described hereinabove will now be described.

In FIG. 3, L/R stereo input signals are inputted to the second signal processing portion 11. Within the second signal processing portion 11, computation processing such as convolution or filtering computation or the like is applied to the stereo input signals by the sound effect generating portion 12, and the sound effects such as initial reflection sounds, reverberation sounds or the like are generated. The sound effects are adjusted in gain by the first sound effect adjusting multiplier 13 and the second sound effect adjusting multiplier 14. The L/R stereo input signals are adjusted in gain by the L channel direct sound adjusting multiplier 15 and the R channel direct sound adjusting multiplier 16. Thereafter, they are respectively added to the gain adjusted sound effects and output from the second signal processing portion 11.

Figure 5:
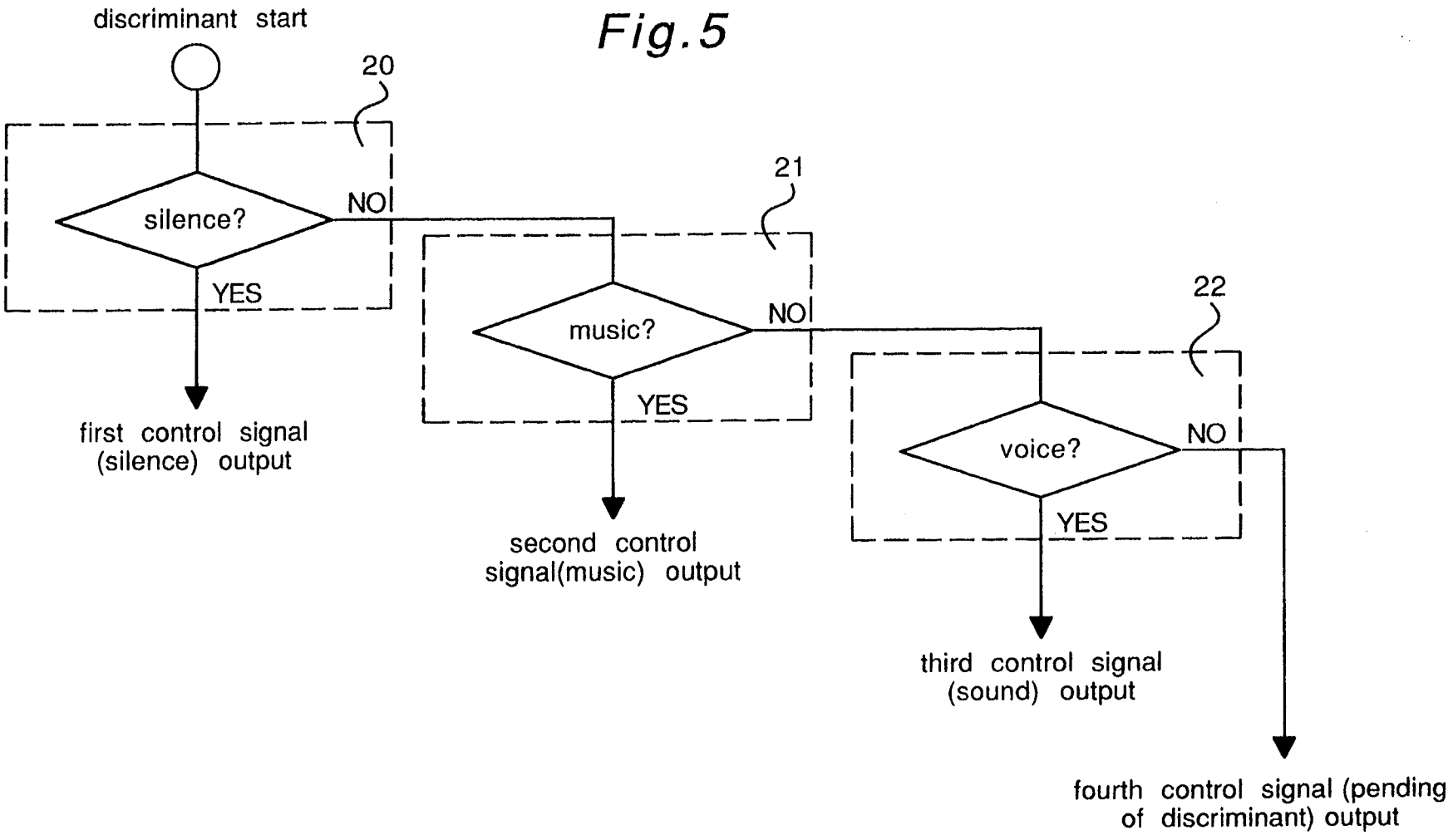
FIG. 5 is a flow chart showing a decision process in a music/voice deciding portion which is a component of the music/voice processing apparatus of the present invention.

The L/R stereo input signals are also inputted to the music/voice deciding portion 17. The music/voice deciding portion 17 is composed of the second sound/silence deciding portion 20, the music deciding portion 21, and the voice deciding portion 22 as shown in FIG. 4. A decision process is effected repeatedly as described in FIG. 5.

Namely, in the second sound/silence deciding portion 20, it is judged whether the input signal represents sound or silence. When silence is judged, a control signal denoting the silence condition is externally outputted and the process returns to the start position to again begin the decision process.

When the input signal has been judged as sound, the process proceeds to the music deciding portion 21 so as to judge whether the input signal represents music. If the input signal is judged as music, a control signal denoting music is externally outputted and the process returns to the start position to repeat the decision process.

When it has been judged that the input signal does not represent music, the process proceeds to the voice deciding portion 22 so as to judge whether the input signal represents voice. If the input signal is judged as voice, a control signal denoting voice is externally outputted. When the input signal has been judged as non-voice, a control signal denoting a reservation of the decision is externally outputted indicating that music or voice cannot be discriminated with a high probability of correctness, and the process returns to the start position to repeat the decision process.

Although the above described series of deciding operations is continuously repeated, it need only be repeated, for example, for each of one or several sampling periods.

Referring .again to FIG. 3, the volume of the sound effects and the direct sound are set in advance in the parameter setting portion 19 as values most suitable for music, values most suitable for voice and so on and are transmitted as acoustic parameters to the parameter control portion 18, such as each gain coefficient of the first sound effect adjusting multiplier 13, the second sound effect adjusting multiplier 14, the L channel direct sound adjusting multiplier 15 and the R channel direct sound adjusting multiplier 16.

The parameter control portion 18 receives the control signal from the music/voice deciding portion 17 so as to slightly correct the gain of each of the above described multipliers so that the volumes of the existing state of the sound effects and the direct sounds may become closer to a value most suitable to predetermined music if the input signals represent music. If voice is represented, the above described gain is slightly corrected to a value most suitable for voice. In the case of silence or a decision reservation, the gain is not corrected.

Figure 6:
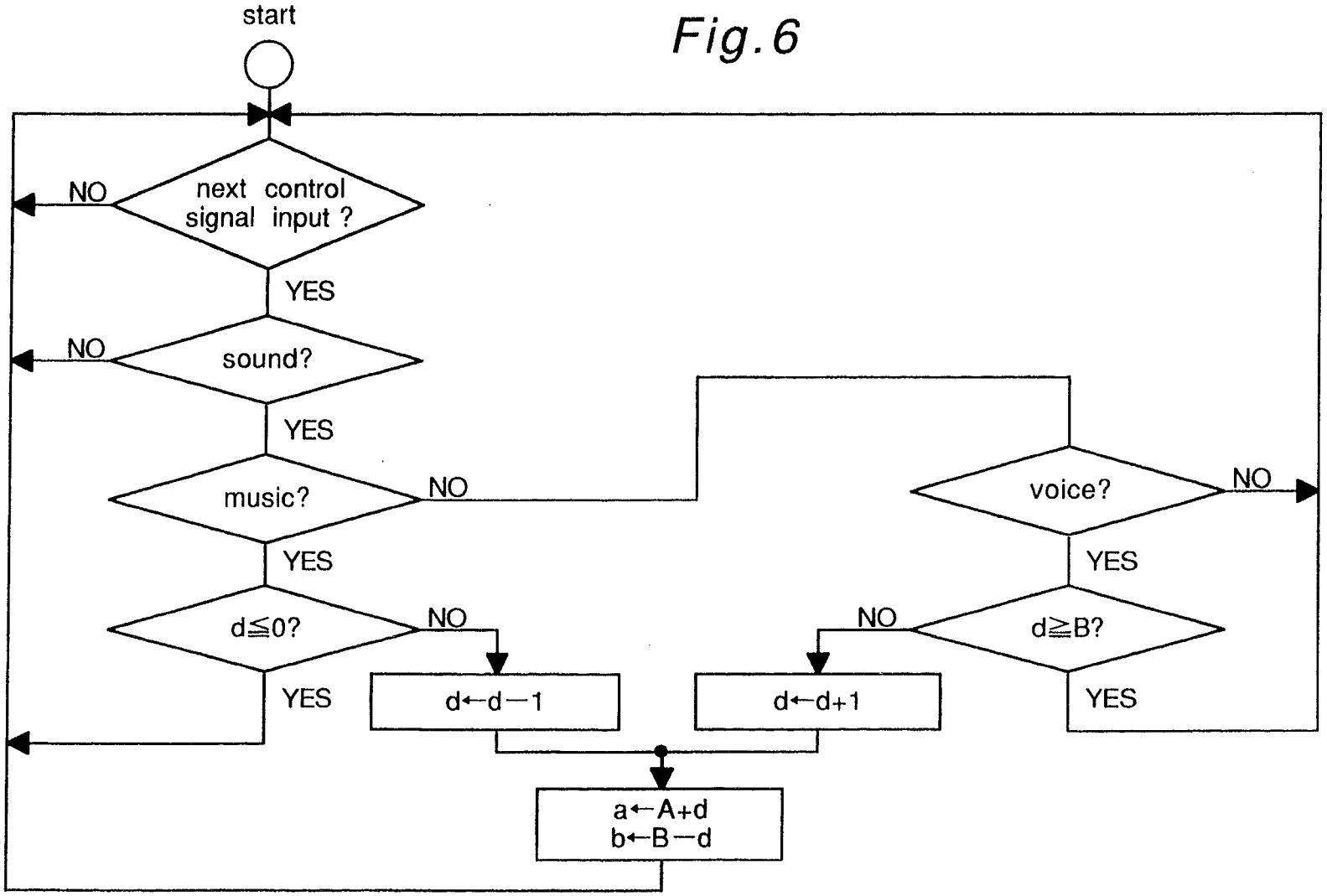
FIG. 6 is a flow chart showing sound volume control as one example of an acoustic parameter control in a parameter control portion which is a component of the music/voice processing apparatus of the present invention.

FIG. 6 shows a process of an embodiment of the gain correction of the above described sound effect and the direct sound in the parameter control portion 18.

In FIG. 6, the volume for sound effect, namely, the gains of the first sound effect adjusting multiplier 13 and the second sound effect adjusting multiplier 14 are represented as b, and the volume for direct sound, namely, the gains of the L channel direct sound adjusting multiplier 15 and the R channel direct sound adjusting multiplier 16 are represented as a. The most suitable values of a, b in a case of music reproduction are set in advance as A, B. The most suitable values of a, b in a case of voice reproduction are set in advance as (A+B), O. Also, the gains a, b set in each of the above described multipliers 13 to 16 are represented as shown in the following formulas, $$a=A+d$$

$$b=B-d$$

$$(O \leqq d=B)$$

where d takes a value between O through B, and, if it is O, it is a most suitable value of music reproduction, and if it is B, it is a most suitable value of voice reproduction. Each value of A, B, d is considered an integer which is sufficiently larger than 1.

In FIG. 6, first the input of the control signal from the music/voice decision portion 17 is awaited. When the control signal is inputted and the control signal denotes silence, the input of the next control signal is awaited without effecting gain correction.

If the control signal denotes music, the input of the next control signal is awaited without effecting gain correction if d is already O. If d is larger than O, then d is reduced by 1 so as to calculate a, b again for setting in each of the above described multipliers 13 to 16.

If the control signal denotes voice, the input of the next control signal is awaited without effecting gain correction if d is already B. If d is smaller than B, 1 is added to d so as to calculate a, b again for setting in each of the above described multipliers 13 to 16.

When the decision is reserved without judgment of music or voice although sound is discriminated, gain correction is not effected so as to await the input of the next control signal.

The correction of the above described gain is repeatedly carried out each time the control signal from the music/voice deciding portion 17 is transferred. If the sound effect and the direct sound volume are set for voice reproduction for the first time in, for example, a case of music reproduction, the volume smoothly changes to the volume setting for music reproduction in, for example, several seconds when music starts to be reproduced.

In the case of silence and in the case where judgment of music and voice is hard to effect, the volume correction is not effected. Since the volume correction is gradually effected little by little and not at one time, even in the case of an erroneous discrimination of the music/voice, the influences of the erroneous decision can be held to a minimum so that extremely stable music reproduction can be realized. The same thing can be said even in the case of the reproduction of voice.

In the above described embodiment, the sound effect is generated as the treatment carried out in the signal processing portion. Without limitation thereto, a filtering operation or the like for tone quality adjustment may be used. Although the acoustic parameter to be controlled is used as the volume of the sound effect and the direction volume, other parameters may be used such as a filter coefficient, reflection sound delay, reverberation time or the like.

Limitation is especially not added to the method of discriminating the music and the voice in the music/voice deciding portion. Also, the control method of acoustic parameters in the parameter control portion is not limited to the method shown in the present embodiment so far as the gradual correcting method is taken.

Also, the acoustic signals to be inputted are not limited to stereo signals, and, for example, may be monoral.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

We claim

1. An apparatus for discriminating a silence condition, a sound condition, a voice condition and a music condition of two channel L, R acoustic signals, comprising;

an adder for calculating a sum of the two channel L, R acoustic signals to generate a sum output signal, a subtractor for calculating a difference between the two channel L, R acoustic signals to generate a difference output signal, and a signal discriminator for discriminating whether the two channel L, R acoustic signals are in the silence condition or in the sound condition, and whether the two channel L, R acoustic signals are in the music condition or in the voice condition when discriminated in the sound condition, the signal discriminator including a sound/silence judging portion for judging the sound condition or the silence condition in accordance with the two channel L, R acoustic signals or the sum output signal generated by said adder, and a music/voice deciding portion for judging whether the two channel L, R acoustic signals are in the music condition or the voice condition in accordance with the sum output signal generated by said adder and the difference output signal generated by said subtractor, wherein the sound/silence judging portion includes a sound/silence comparing portion for comparing an amplitude of the L acoustic signal and the R acoustic signal or an amplitude of the sum output signal generated by said adder with a predetermined sound/silence judging coefficient so as to discriminate the silence condition when the amplitude is the predetermined sound/silence judging coefficient or less, and so as to discriminate the sound condition when the amplitude is more than the predetermined sound/silence judging coefficient.

2. The apparatus as defined in claim 1, wherein, when the sound/silent judging portion discriminates the silence condition, the judgment of the music/voice judging portion is not effected or the judgment result of the music/voice judging portion is neglected.

3. An apparatus for discriminating a silence condition, a sound condition, a voice condition and a music condition of two channel L, R acoustic signals, comprising;

an adder for calculating a sum of the two channel L, R acoustic signals to generate a sum output signal, a subtractor for calculating a difference between the two channel L, R acoustic signals to generate a difference output signal, and a signal discriminator for discriminating whether the two channel L, R acoustic signals are in the silence condition or in the sound condition, and whether the two channel L, R acoustic signals are in the music condition or in the voice condition when discriminated in the sound condition, the signal discriminator including a sound/silence judging portion for judging the sound condition or the silence condition in accordance with the two channel L, R acoustic or the sum output signal generated by said adder, and a music/voice deciding portion for judging whether the two channel L, R acoustic signals are in the music condition or the voice condition in accordance with the sum output signal generated by said adder and the difference output signal generated by said subtractor, wherein the music/voice deciding portion includes a music comparing portion for comparing a first product of an amplitude of the sum output signal generated by said adder and a predetermined music deciding coefficient with an amplitude of the difference output signal generated by said subtractor, and a voice comparing portion for comparing a second product of the amplitude of the sum output signal generated by said adder and a predetermined voice deciding coefficient with the amplitude of the difference output signal generated by said subtractor, wherein the music comparing portion discriminates the music condition when the amplitude of the difference output signal is larger than the first product, and wherein the voice comparing portion discriminates the voice condition when the amplitude of the difference output signal is smaller than the second product.

4. The apparatus as defined in claim 3, wherein, when the sound/silent judging portion discriminates the silence condition, the judgment of the music/voice judging portion is not effected or the judgment result of the music/voice judging portion is neglected.

5. An apparatus for discriminating a silence condition, a sound condition, a voice condition and a music condition of two channel L, R acoustic signals, comprising;

an adder for calculating a sum of the two channel L, R acoustic signals to generate a sum output signal, a subtractor for calculating a difference between the two channel L, R acoustic signals to generate a difference output signal, and a signal discriminator for discriminating whether the two channel L, R acoustic signals are in the silence condition or in the sound condition, and whether the two channel L, R acoustic signals are in the music condition or in the voice condition when discriminated in the sound condition, the signal discriminator including a sound/silence judging portion for judging the sound condition or the silence condition in accordance with the two channel L, R acoustic signals or the sum output signal generated by said adder, and a music/voice deciding portion for judging whether the two channel L, R acoustic signals are in the music condition or the voice condition in accordance with the sum output signal generated by said adder and the difference output signal generated by said subtractor, wherein, when the sound/silent judging portion discriminates the silence condition, the judgment of the music/voice judging portion is not effected or the judgment result of the music/voice judging portion is neglected.

6. A music/voice processing apparatus comprising;

a signal processing portion for effecting acoustic signal processing such as filtering, addition of initial reflection sounds and reverberation sounds, volume adjustment or the like upon inputted acoustic signals, a music/voice deciding portion for continuously or periodically deciding whether the inputted acoustic signals are in a music or a voice condition or in a silence condition, a parameter control portion for variably controlling acoustic parameters for the acoustic signal processing effected by said first signal processing portion in accordance with a decision result of said music/-voice deciding portion, and a parameter setting portion for setting in advance an optimum parameter value for voice, and an optimum parameter value for music, wherein said parameter control portion is further for gradually correcting an existing state of the acoustic parameters little by little so that the acoustic parameters become closer to the optimum parameter value for music when the music condition is decided, and so that the acoustic parameters become closer to the optimum parameter value for voice when the voice condition is decided in accordance with the continuous or periodic decision results of the music/voice deciding portion, and for maintaining the existing state of acoustic parameters when the silence condition is decided and when discrimination of the music condition and voice condition is hard to effect.

* * * * *